US005700163A

United States Patent [19]

Okabe

[11] Patent Number: 5,700,163

[45] Date of Patent: Dec. 23, 1997

[54] PRESS-CONNECTING CONNECTOR WITH INTEGRAL COVER

[75] Inventor: Toshiaki Okabe, Shizuoka, Japan

[73] Assignee: Yazaki Corporation, Tokyo, Japan

[21] Appl. No.: 647,042

[22] Filed: May 9, 1996

[30] Foreign Application Priority Data

May 12, 1995 [JP] Japan ..... 7-114747

[51] Int. Cl.[6] ..... H01R 13/40

[52] U.S. Cl. ..... 439/596; 439/701

[58] Field of Search ..... 439/595, 596, 439/597–600, 682, 686, 687, 695, 701

[56] References Cited

U.S. PATENT DOCUMENTS

| | | | |
|---|---|---|---|
| 5,224,876 | 7/1993 | Ito et al. | 439/595 |
| 5,232,373 | 8/1993 | Sawada | 439/140 |
| 5,466,174 | 11/1995 | Savage, Jr. | 439/596 |
| 5,498,177 | 3/1996 | Tsuji | 439/596 |

FOREIGN PATENT DOCUMENTS

| | | |
|---|---|---|
| 62-200252 | 12/1987 | Japan . |
| 485669 | 7/1992 | Japan . |

*Primary Examiner*—Khiem Nguyen

*Attorney, Agent, or Firm*—Sughrue, Mion, Zinn, Macpeak & Seas, PLLC

[57] ABSTRACT

A press-connecting connector with an integral cover, in which the number of component parts is small, and the production cost can be reduced by reducing the number of steps in a connector housing-molding process, and an automatic assembling process can be simplified by a relatively simple mechanical operation. A press-connecting connector 11 of the invention includes: a housing body 16 having terminal receiving chambers 14 which respectively receive press-connecting terminals 13, and having respective open sides 15, a tubular housing cover 17 fitted on an outer periphery of the housing body 16 to cover the open sides 15 of the terminal receiving chambers 14; connecting piece portions 18 interconnecting the housing body 16 and the housing cover 17 in such a manner that a front end portion of the housing body 16 is received in the housing cover 17; and elastic bands 31 which are integrally connected to the housing body 16 and the housing cover 17, and are disposed in respective spaces 30 provided between the front end portion of the housing body 16 and the housing cover 17.

6 Claims, 5 Drawing Sheets

PRESS-CONNECTING CONNECTOR WITH INTEGRAL COVER

BACKGROUND OF THE INVENTION

1. Field of the Invention

This invention relates to a press-connecting connector with an integral cover, in which a housing body, having a plurality of terminal receiving chambers (each having an open side) respectively receiving press-connecting terminals, and a housing cover are molded integrally with each other.

2. Related Art

A conventional press-connecting connector, used for connecting a wire harness mounted in a vehicle such as an automobile is disclosed in Japanese Utility Model Unexamined Publication No. 62-200252.

As shown in FIG. 8, the press-connecting connector comprises a housing body A, a housing cover B, and a plurality of press-connecting terminals C received in the housing body A.

The housing body A is injection molded of a resin, and has an integral construction, and comprises a pair of housing units A1 and A2 interconnected by a connecting band 1 serving as a hinge. Each of the housing units A1 and A2 has a row of terminal receiving chambers 2*a*, 2*b* (having an open top) for receiving the respective press-connecting terminals C. The housing units A1 and A2 are joined together by the connecting band 1 in such a manner that the open sides of the terminal receiving chambers 2*a* and 2*b* are directed upwardly when the housing body A is open.

The housing cover B is injection molded of a resin, and has an integral construction, and is held between the housing units A1 and A2 stacked together with the connecting band 1 bent. This housing cover includes a partition plate 3 for covering the open sides of the terminal receiving chambers 2*a* and 2*b*, and connecting portions 6 which are integrally formed respectively on opposite side edges of the partition plate 3, each of the connecting portions 6 having an engagement groove 5 engageable with retaining projections 4 formed on outer surfaces of the housing units A1 and A2.

The press-connecting terminal C of an integral construction is formed by bending a metal sheet, and includes a terminal fitting portion 7 for receiving a mating press-connecting terminal, a pair of press-connecting blades 8 which cut a sheath of a sheathed wire W in order to be electrically connected to a conductor of the sheathed wire, wire clamping portions 9 for fixedly holding the sheathed wire W, and a bending portion 10 for bending the sheathed wire W to prevent rearward withdrawal of the sheathed wire W.

In the press-connecting connector of the above construction, the press-connecting terminals C are mounted respectively in the terminal receiving chambers 2*a* and 2*b* of the housing units A1 and A2 when the same are held in an open condition shown in FIG. 8, and the sheathed wires W are press-connected to the press-connecting terminals C, respectively. Then, the housing units A1 and A2 are closed together, with the partition plate 3 of the housing cover B held therebetween.

Therefore, as shown in FIGS. 9 and 10, the retaining projections 4, formed on the outer surfaces of the housing units A1 and A2, are engaged in the associated engagement grooves 5 of the housing cover B, thus completing the assembly of the press-connecting connector.

In the press-connecting connector of FIGS. 8 to 10, the housing body A and the housing cover B must be molded separately from each other, and this inevitably increases the molding steps, so that the production cost is increased.

Although the component parts can be supplied by a part feeder or the like, the pivotal movement of the housing units A1 and A2 about the connecting band 1 (serving as the hinge) in the opening and closing directions, as well as the mounting of the housing cover B between the housing units A1 and A2, can not be easily effected automatically.

Also, when the housing units A1 and A2 are closed together, the bent or curved portion of the connecting band 1 is projected from the side of the housing body A, and it is possible that this projected portion will become caught by another member during the transfer on an automatic assembling line, thus causing improper transfer. Therefore, structural improvement is necessary.

SUMMARY OF THE INVENTION

It is therefore an object of this invention to overcome the above problems, and more specifically to provide a press-connecting connector with an integral cover, in which the number of component parts is small, the production cost can be reduced by reducing the number of steps of a connector housing-molding process, and an automatic assembling process can be simplified by a relatively simple mechanical operation.

The above objects of the invention are achieved by a press-connecting connector with an integral cover comprising a housing body which has a predetermined number of terminal receiving chambers respectively receiving press-connecting terminals, and is open to an outer periphery of the housing body; and a housing cover fitted on the outer periphery of the housing body to cover open sides of the housing body; CHARACTERIZED in that the housing body and the housing cover are molded integrally with each other through connecting piece portions which are cut off when the housing cover is to be completely fitted on the housing body; and elastic bands are integrally connected to the housing body and the housing cover, and are disposed in respective spaces each provided between a front end portion of the housing body, and disposed within the housing cover.

The above object can be achieved by a construction in which each of the elastic bands is connected at one end thereof to the front end of the housing body, and also is connected at the other end thereof to an inner peripheral surface of the housing cover in such a manner as to allow the movement of the housing body in a direction of pushing of the housing body.

Since the housing body and the housing cover are molded integrally with each other, the number of molds to be used, as well as the number of steps of a connector housing-molding process, is reduced, and also the number of the component parts is reduced. The connecting piece portions, through which the housing body and the housing cover are integrally connected, are cut off, and then the housing body is further pushed into the housing cover.

Namely, the housing body and the housing cover are linearly pushed relative to each other, and therefore the assembly of the press-connecting connector can be completed by a simple, less mechanical operation.

Since the elastic bands are not projected outwardly from the housing, there is little chance that any part of the connector will become caught by another member during the transfer on an automatic assembling line, and therefore improper transfer will not occur.

Even after the connecting piece portions are cut off, the housing body and the housing cover are still interconnected by the elastic bands, and therefore the housing body and the housing cover are positively prevented from being accidentally disengaged from each other.

When the housing body is further pushed into the housing cover, the elastic bands limit the movement of the housing body in the housing cover, and therefore the pushing of the housing body into the housing cover can be effected smoothly and positively.

DESCRIPTION OF THE PREFERRED EMBODIMENTS

Figure 1:
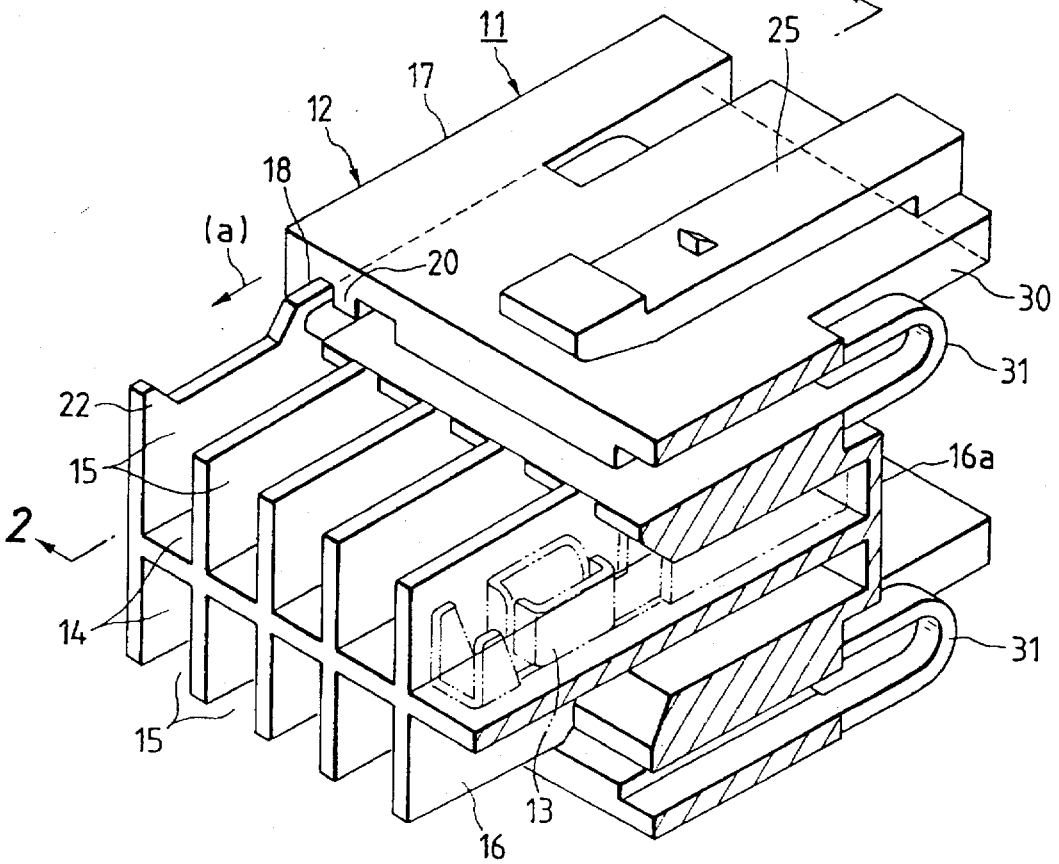
FIG. 1 is a perspective view of one embodiment of a press-connecting connector of the invention with an integral cover, showing a condition before a housing Brief Description of the Drawings body and a housing cover are completely fitted together.

One preferred embodiment of a press-connecting connector of the invention with an integral cover will now be described in detailed with reference to FIGS. 1 to 5. As shown in FIG. 1, the press-connecting connector 11 of this embodiment comprises a connector housing 12 which is integrally constructed of an injection molded resin, and press-connecting terminals 13 received and held in the connector housing 12, each of the press-connecting terminals 13 being formed by bending a metal sheet.

The connector housing 12 includes a housing body 16 in which two rows (that is, upper and lower rows) of terminal receiving chambers 14, which respectively receive the press-connecting terminals 13, are formed in such a manner that open sides 15 of these chambers 14 are directed to an outer periphery of the housing body 16. The connector housing 12 also includes a tubular housing cover 17 of a rectangular cross-section which is fitted on the outer periphery of the housing body 16 from a front side of the housing body 16 (as indicated by arrow a) in the direction of extension of the terminal receiving chambers 14 so as to cover the open sides 15. Connecting piece portions 18 interconnect the housing body 16 and the housing cover 17 in such a manner that a front end 16*a* of the housing body 16 is received in the housing cover 17. Therefore, the connector housing 12 has an integrally-molded construction in which the housing body 16 is formed integrally with the housing cover 17 through the connecting piece portions 18.

Figure 2:
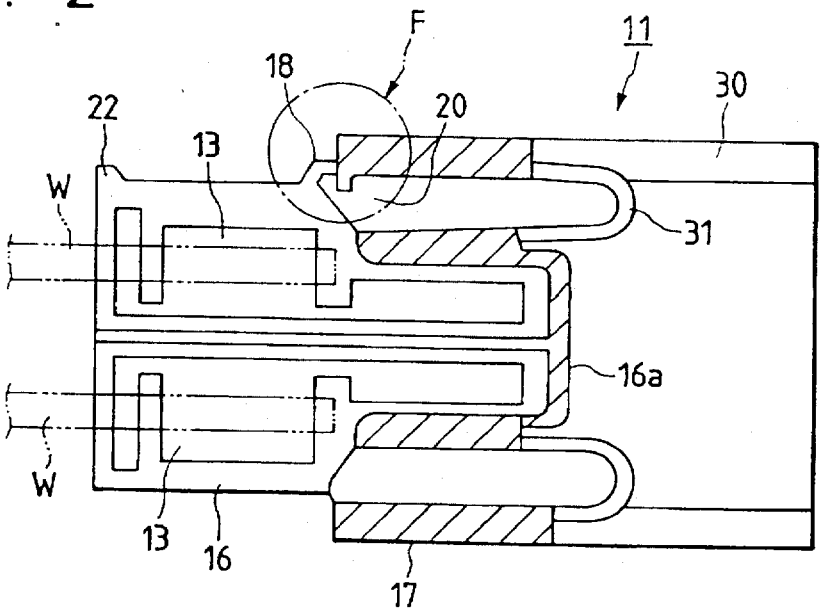
FIG. 2 is a cross-sectional view taken along the line 2—2 of FIG. 1, showing an integrally-molded construction of a connector housing.

As shown in FIG. 2, retaining projections 22 are formed on a rear end of the housing body 16 which is disposed outwardly of the housing cover 17 when the connector housing is integrally molded, and when the housing body 16 is pushed into the housing cover 17, these retaining projections 22 are engaged with a projected edge 20 of the housing cover 17, thereby preventing rearward withdrawal of the housing body 16.

Four elastic bands 31 are formed integrally with the connector housing, and are disposed in corresponding spaces 30 provided between the front end 16*a* of the housing body 16 (which is disposed within the housing cover 17 when the connector housing is integrally molded) and the housing cover 17.

Each elastic band 31 is bent into a generally U-shape, and is connected at one end to the front end 16*a* of the housing body 16, and is also connected at the other end to the inner peripheral surface of the housing cover 17. The elastic bands 31 are connected to the housing cover 17 in such a manner as to allow the movement of the housing body 16 in the direction of pushing thereof, thereby determining the optimum range of movement of the housing body 16 in the housing cover 17.

Namely, the elastic bands 31 serve to position the housing body 16 in the housing cover 17 since they are bent into a generally U-shape, and besides when the connecting piece portions 18 are cut off, the elastic bands 31 limit the movement of the housing body 16 relative to the housing cover 17 in forward and backward directions.

Figure 5:
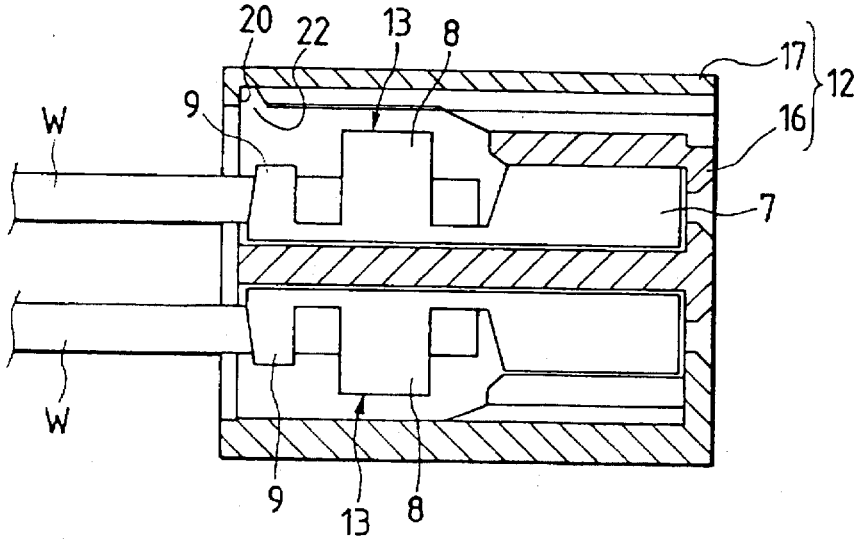
FIG. 5 is a cross-sectional view taken along the line 5—5 of FIG. 4.

The press-connecting terminals 13 may have a construction as shown in FIG. 5. In this embodiment, the terminal 13 includes a terminal fitting portion 7 for receiving a mating press-connecting terminal or the like, a press-connecting blade 8 which cuts a sheath of a sheathed wire W in order to be electrically connected to a conductor of the sheathed wire when the sheathed wire is press-fitted into the press-connecting blade 8, and wire clamping portions 9 for embracing the sheath to hold the sheathed wire W press-fitted in the press-connecting blade 8.

Figure 3:
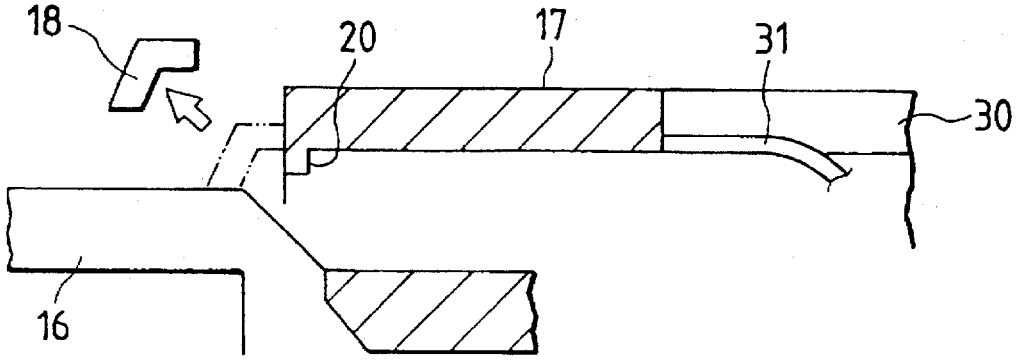
FIG. 3 is a view showing the manner of cutting off a connecting piece portion of the connector housing of FIG. 1.

In the connector housing 12 of the above construction, after the press-connecting terminals 13 are mounted respectively in the terminal receiving chambers 14 in the housing body 16, the connecting piece portions 18 are cut off by an automatic cutter or the like as shown in FIG. 3. Then, as shown in FIG. 5, the housing body 16 is pushed a predetermined amount to be further inserted into the housing cover 17. As a result, the retaining projections 22, formed at the rear end of the housing body 16, pass past the projected edge 20 of the housing cover 17, and are introduced into the housing cover 17, thereby preventing the rearward withdrawal of the housing body 16, and also the elastic bands 31 are fully expanded, thereby limiting the forward movement of the housing body 16.

Figure 4:
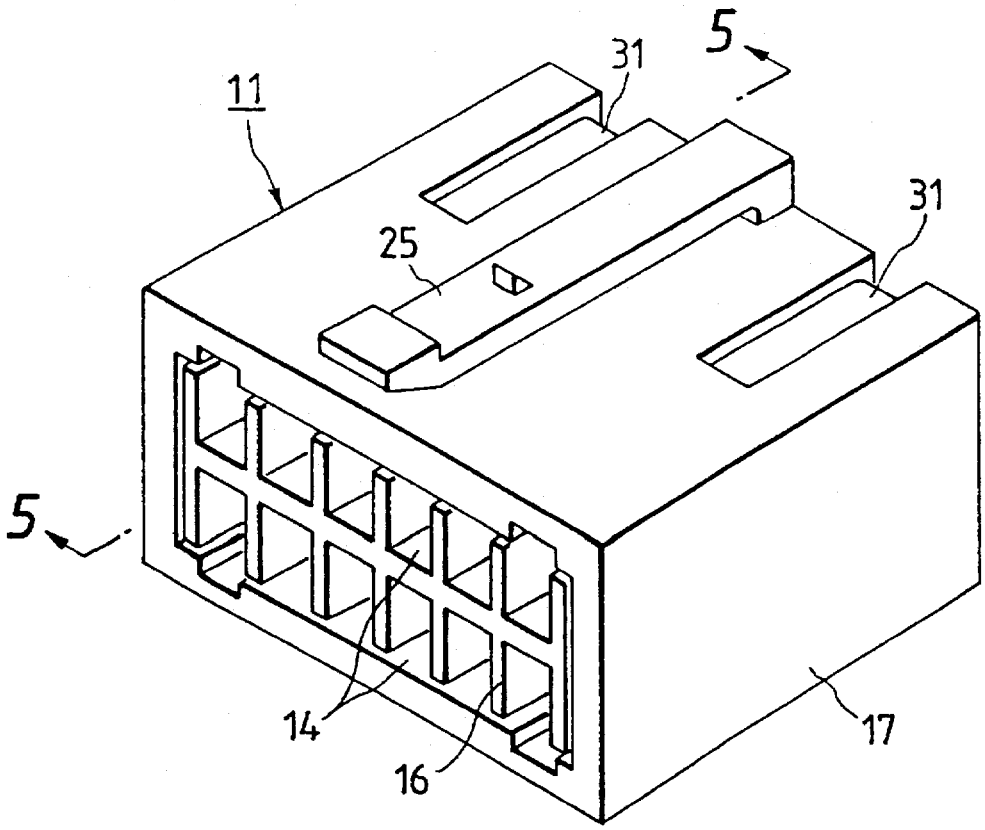
FIG. 4 is a perspective view showing a completely-assembled condition of the press-connecting connector of FIG. 1.

Therefore, the open sides 15 of the terminal receiving chambers 14 are covered by the peripheral wall of the housing cover 17 as shown in FIGS. 4 and 5, thus completing the assembling of the press-connecting connector.

As described above, the connector housing 12 of the press-connecting connector of this embodiment is integrally molded in such a manner that the housing body 16 and the housing cover 17 are formed integrally with each other, and therefore the number of the component parts is small, and the number of molds to be used, as well as the number of steps of the process of molding the connector housing 12, is reduced, so that the production cost can be reduced. The connecting piece portions 18, through which the housing body 16 and the housing cover 17 are integrally connected together, are cut off, and then the housing body 16 is pushed into the housing cover 17. Thus, the press-connecting connector 11 can be easily assembled by a simple, less mechanical operation in which the housing body 16 and the housing cover 17 are linearly pushed relative to each other.

There is no hinge portion projecting outwardly from the connector housing, and therefore there is little chance that such portion will become caught by another member during the transfer on an automatic assembling line, and therefore improper transfer will not occur. Therefore, the automatic assembly operation can be achieved easily, which is critical in the automated production of wire harnesses.

Even after the connecting piece portions 18 are cut off, the housing body 16 and the housing cover 17 are still interconnected by the elastic bands 31, and therefore the housing body 16 and the housing cover 17 are positively prevented from being accidentally disengaged from each other.

When the housing body 16 is further pushed into the housing cover 17, the elastic bands 31 limit the movement of the housing body 16 in the housing cover 17, and therefore the pushing of the housing body 16 into the housing cover 17 can be effected smoothly and positively, so that the reliability of the component parts assembled together is enhanced.

Figure 6:
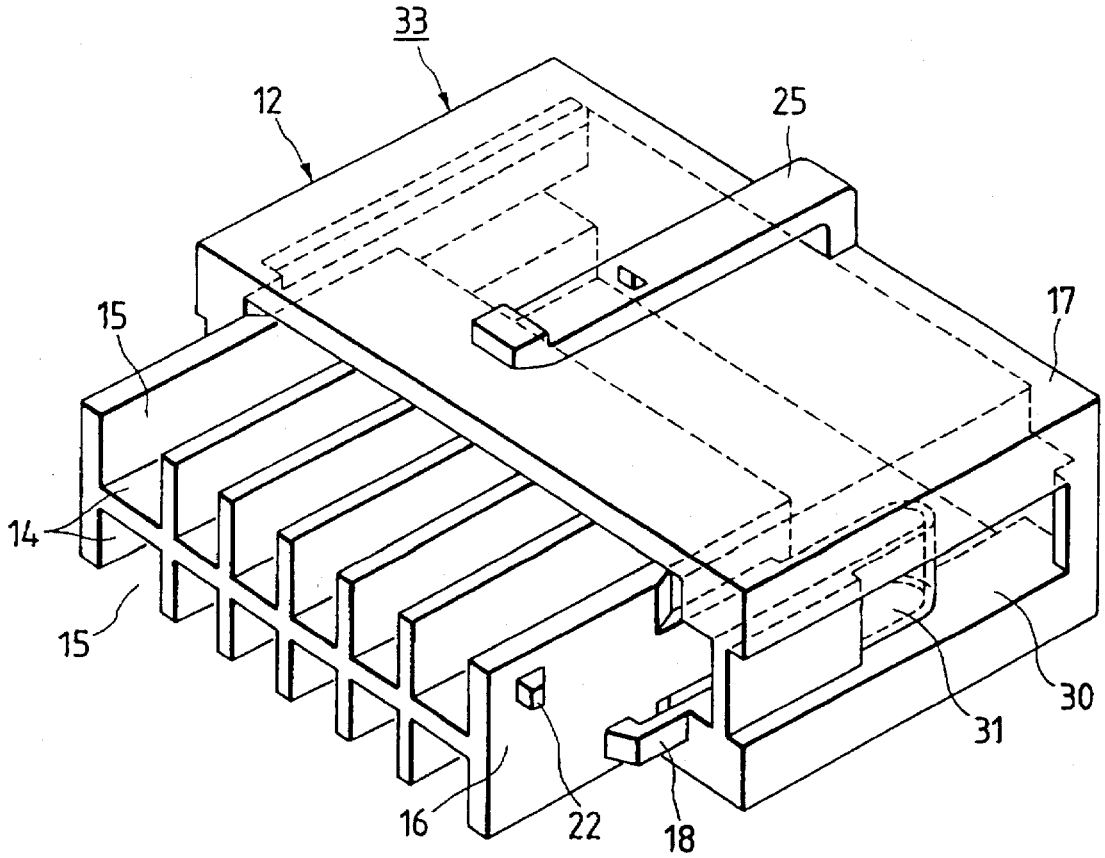
FIG. 6 is a perspective view of another embodiment of a press-connecting connector of the invention with an integral cover.

Another preferred embodiment of a press-connecting connector of the invention with an integral cover will now be described in detail with reference to FIGS. 6 and 7. This embodiment differs in that elastic bands 31, connecting piece portions 18 and retaining projections 22 are provided on side portions of a housing body 16. As shown in FIG. 6, a connector housing 12 includes the housing body 16 in which two rows (that is, upper and lower rows) of terminal receiving chambers 14, which respectively receive press-connecting terminals, are formed. The connector housing 12 also includes a housing cover 17 which is fitted on the outer periphery of the housing body 16 from a front side of the housing body 16 in a direction of extension of the terminal receiving chambers 14 so as to cover open sides 15 of these terminal receiving chambers. The connecting piece portions 18 are integrally formed respectively on the opposite side walls of the housing body 16, and interconnect the housing body 16 and the housing cover 17 in such a manner that a front end portion of the housing body 16 is received in the housing cover 17.

Figure 7:
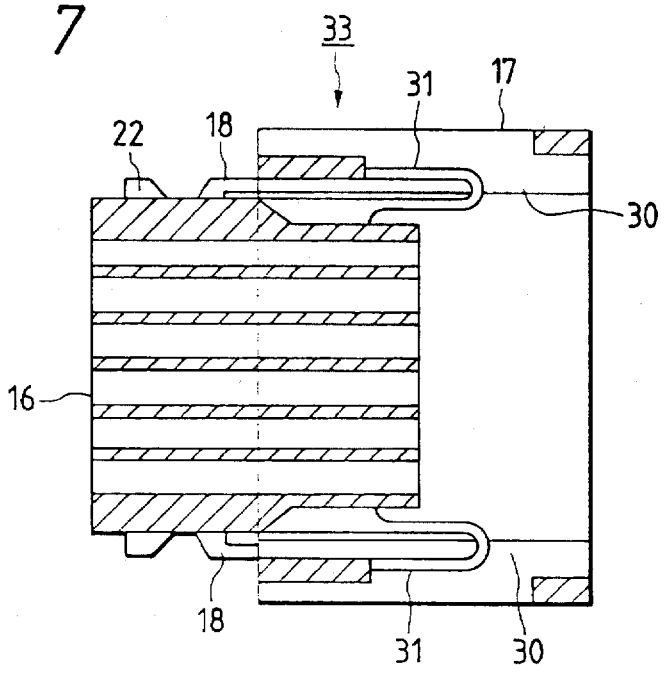
FIG. 7 is a cross-sectional view of the connector of FIG. 6.
Figure 8:
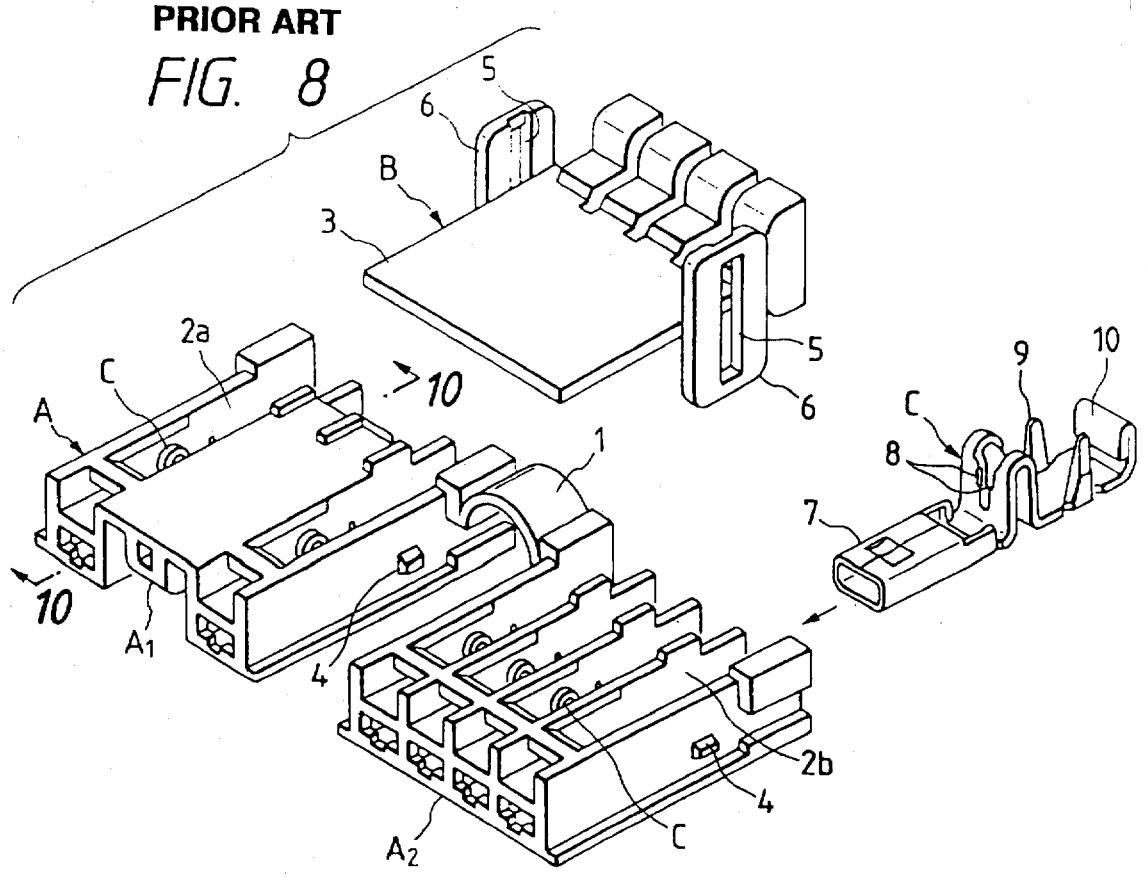
PRIOR ART FIG. 8
FIG. 8 is an exploded, perspective view of a conventional press-connecting connector.
Figure 9:
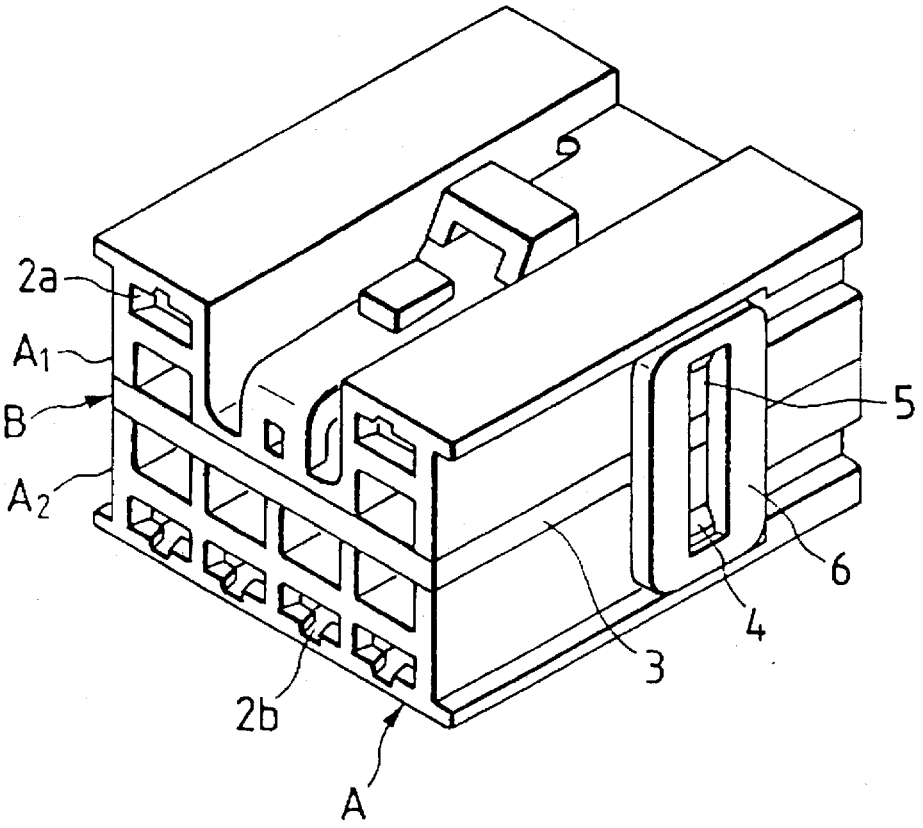
PRIOR ART FIG. 9
FIG. 9 is a perspective view of the press-connecting connector of FIG. 8 in its assembled condition.
Figure 10:
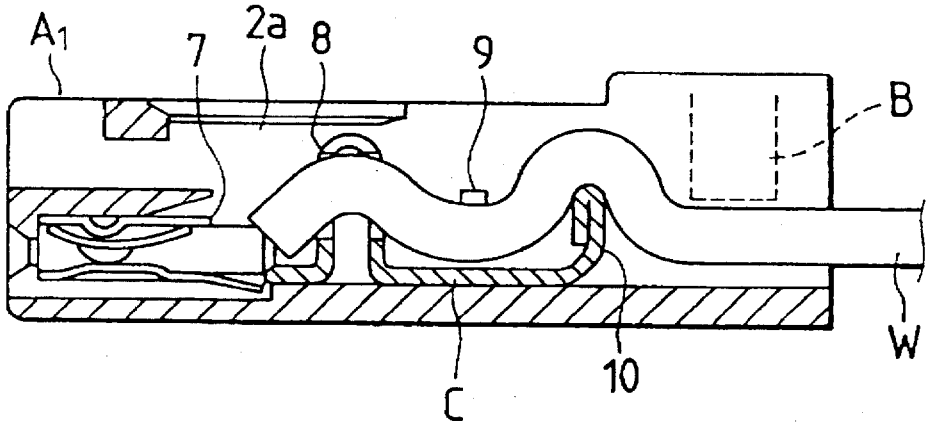
PRIOR ART FIG. 10
FIG. 10 is a cross-sectional view taken along the line 10—10 of FIG. 8.

As shown in FIG. 7, the retaining projections 22 are formed respectively on rear end portions of the opposite side walls of the housing body 16 which face outward toward the housing cover 17 when the housing body 16 is pushed into the housing cover 17. The retaining projections 22 engage with a rear end edge of the housing cover 17, thereby preventing rearward withdrawal of the housing body 16.

Elastic bands 31 are formed integrally with the connector housing, and are disposed respectively in spaces 30 provided between the front end portion of the corresponding side wall of the housing body 16 (which is disposed within the housing cover 17 when the connector housing is integrally molded) and the housing cover 17.

Each elastic band 31 is bent into a generally U-shape, and is connected at one end to the side wall of the housing body 16, and is also connected at the other end to the inner peripheral surface of the housing cover 17. The elastic bands 31 are connected to the housing cover 17 in such a manner as to allow the movement of the housing body 16 in the direction of pushing thereof, thereby determining the optimum range of movement of the housing body 16 in the housing cover 17.

In the connector housing 12 of the above construction, after the press-connecting terminals 13 are mounted respectively in the terminal receiving chambers 14 in the housing body 16, the connecting piece portions 18 are cut off by an automatic cutter or the like. Then, the housing body 16 is pushed a predetermined amount to be further inserted into the housing cover 17, so that the retaining projections 22 are engaged with the rear end edge of the housing cover 17, thereby preventing the rearward withdrawal of the housing body 16, and also the elastic bands 31 are fully expanded, thereby limiting the forward movement of the housing body 16.

Therefore, the open sides 15 of the terminal receiving chambers 14 are covered by the peripheral wall of the housing cover 17, thus completing the assembling of the press-connecting connector.

As described above, the connector housing 12 of the press-connecting connector 33 of this embodiment is integrally molded in such a manner that the housing body 16 and the housing cover 17 are formed integrally with each other as in the preceding embodiment, and the aforementioned advantages achieved by the first embodiment can be achieved by the pair of elastic bands 31 provided respectively on the opposite sides of the housing body 16.

Therefore, the number of the component parts is small, and the number of molds to be used, as well as the number of steps of the process of molding the connector housing 12, is reduced, so that the production cost can be reduced.

Also, the press-connecting connector 33 can be easily assembled by a simple, less mechanical operation in which the housing body 16 and the housing cover 17 are linearly pushed relative to each other.

Since the elastic bands 31 are formed respectively on the opposite sides of the housing body 16, the area of the open sides 15 can be increased, and therefore the assembling operation can be automated more easily.

There is no hinge portion projecting outwardly from the housing, and therefore there is little chance that such portion will become caught by another member during the transfer on an automatic assembly line, and therefore improper transfer will not occur.

Even after the connecting piece portions 18 are cut off, the housing body 16 and the housing cover 17 are still interconnected by the elastic bands 31, and therefore the housing body 16 and the housing cover 17 are positively prevented from being accidentally disengaged from each other.

When the housing body 16 is further pushed into the housing cover 17, the elastic bands 31 limit the movement of the housing body 16 in the housing cover 17, and therefore the pushing of the housing body 16 into the housing cover 17 can be effected smoothly and positively, so that the reliability of the component parts assembled together is enhanced.

In the press-connecting connectors of the invention with the integral cover, the housing body and the housing cover are molded integrally with each other through the connecting piece portions which are cut off when the housing cover is to be completely fitted on the housing body. Also, the elastic bands, integrally connected to the housing body and the housing cover, are provided in the corresponding spaces each disposed between the front end portion of the housing body (which is disposed in the housing cover) and the housing cover.

The elastic bands are connected at one end thereof to the front end portion of the housing body, and are also connected at the other end thereof to the inner peripheral surface of the housing cover in a manner to allow the movement of the housing body in the direction of pushing thereof.

The above-described preferred embodiments are provided for the purpose of illustration and explanation. Many variations in detail may be made to the preferred embodiment without varying from the spirit and scope of the invention, as defined below.

What is claimed is:

1. A press-connecting connector with an integral cover comprising:

a housing body which has a predetermined number of terminal receiving chambers for respectively receiving press-connecting terminals, said terminal receiving chambers having open sides directed towards an outer periphery of said housing body; and a housing cover fitted on the outer periphery of said housing body to cover the open sides of said terminal receiving chambers, wherein said housing body and said housing cover are molded integrally with each other through connecting piece portions which are cut off when said housing cover is to be completely fitted on said housing body, and elastic bands are integrally connected to said housing body and said housing cover, and are disposed in respective spaces provided between a front end portion of said housing body and said housing cover.

2. A press-connecting connector with an integral cover according to claim 1, in which each of said elastic bands is connected at a first end thereof to the front end portion of said housing body, and is connected at a second end thereof to an inner peripheral surface of said housing cover in such a manner as to allow the movement of said housing body in a direction of insertion of said housing body into said housing cover.

3. A press-connecting connector as in claim 1, wherein said connecting piece portions are formed on an upper surface of said housing body adjacent to said open sides.

4. A press-connecting connector with an integral cover comprising:

a housing body which has a predetermined number of terminal receiving chambers for respectively receiving press-connecting terminals, said terminal receiving chambers having open sides directed towards an outer periphery of said housing body; and a housing cover fitted on the outer periphery of said housing body to cover the open sides of said terminal receiving chambers, wherein said housing body and said housing cover are molded integrally with each other through connecting piece portions which are cut off when said housing cover is to be completely fitted on said housing body, and elastic bands are integrally connected to said housing body and said housing cover, and are disposed in respective spaces provided between a front end portion of a corresponding side wall of the housing body and the housing cover.

5. A press-connecting connector as in claim 4, wherein said connecting piece portions are integrally formed on opposite side walls of the housing body.

6. A press-connecting connector as in claim 4, wherein the spaces are provided between the front end portion of a corresponding side wall of the housing body and the housing cover.

* * * * *